United States Patent [19]

Harvey

[11] 4,001,831

[45] Jan. 4, 1977

[54] PORTABLE ANTENNA MOUNT FOR TRUCKS

[75] Inventor: Harold F. Harvey, Sand Springs, Okla.

[73] Assignee: Millard F. Roberts, Tulsa, Okla. ; a part interest

[22] Filed: Aug. 1, 1975

[21] Appl. No.: 601,166

[52] U.S. Cl. ..... 343/715; 343/720

[51] Int. Cl.[2] ..... H01E 1/32

[58] Field of Search ..... 343/715, 711, 712, 713, 343/720, 880, 881, 882

[56] References Cited

UNITED STATES PATENTS

| | | | |
|---|---|---|---|
| 3,624,662 | 11/1971 | Feder | 343/882 |
| 3,710,339 | 1/1973 | Rima | 343/715 |

FOREIGN PATENTS OR APPLICATIONS

| | | | |
|---|---|---|---|
| 573,762 | 12/1945 | United Kingdom | 343/880 |

*Primary Examiner*—Alfred S. Smith
*Assistant Examiner*—David K. Moore
*Attorney, Agent, or Firm*—Head, Johnson & Chafin

[57] ABSTRACT

An antenna attachment means for removably securing a citizen's-band (C-B) antenna or the like to the rear-view mirror bracket of a truck or other similar vehicle. The attachment means is provided with a spring urged pair of telescoping members which mount directly to the standard vehicle mirror bracket. The upper end of the telescoping members is provided with a cap plate for mounting the antenna, the cap plate being removable for folding the antenna along side the attachment means to facilitate storing of the antenna without having to loosen any bolts or screws.

6 Claims, 2 Drawing Figures

PORTABLE ANTENNA MOUNT FOR TRUCKS

BACKGROUND OF THE INVENTION

1. Field of the Invention

The present invention relates to antenna mounts and more particularly, but not by way of limitation, to an antenna attachment means particularly designed and constructed for removable attachment to the standard rearview mirror brackets of trucks and other similar vehicles.

2. Background of the Invention

Most long distance truck drivers operate citizen's band radio equipment from their truck tractor for the purpose of staying in communication with other truck drivers on the road, both for the safety reasons associated with relaying road conditions and information and also for the personal entertainment of the drivers while making long hauls.

For the most part, trucking companies do not provide this equipment to the driver. The drivers therefore normally own their own equipment consisting of the citizen's band transceiver and associated antenna.

However, it is often the case that in travelling across country, the driver may be required to change tractor equipment several times during one complete haul. Therefore each time that he changes tractor equipment he must remove his radio equipment from the first tractor and install same in the second tractor. The transceiver equipment is easily removed but the antennas which must be mounted exteriorly of the truck are often cumbersome and hard to manage.

Most trucks or trailer pulling vehicles are provided with side mounted rearview mirrors which normally employ a rather heavy duty pair of vertically spaced parallel frame members extending outwardly from the side of the vehicle carrying the rearview mirror. Various antenna attachment devices have been developed for attachment to these mirror frames such as the telescoping member taught in the patent to Rima No. 3,710,339, issued Jan. 9, 1973 and entitled "Portable Antenna Mount for Trucks." The Rima device consists of spring-urged telescoping members having oppositely disposed hook members for attachment of the device to the standard rearview mirror frame members. However, the Rima device, while providing a means for folding the antenna with respect to the mount for storage purposes, mounts the antenna directly to a vertically disposed plate by means of a bolt which serves as the upper spring hanger. Therefore, in order to fold the antenna it would be necessary to either loosen the bolt with a screw driver or the like or to leave the bolt in a loosened condition in the first place which would be undesirable from a standpoint of stability. Further, the mounting of the antenna to the verticle plate would be unsatisfactory since wind currents greatly affect the antenna and would cause loosening or inadvertent folding while the truck is in motion.

SUMMARY OF THE INVENTION

The present invention is particlarly designed and constructed to provide an antenna attachment means having spring-urged telescoping members similar to that taught in Rima but being provided with an antenna mounting cap plate which is horizontally disposed thereby eliminating problems associated with collapsing due to adverse wind currents. The cap plate is disposed at the upper end of the outer telescoping member and is held in place on the telescoping member by the spring means when the antenna is in use.

The attachment device also provide a unique means for folding the antenna along side the mounting means for storage purposes without requiring any tools and yet providing for full stability when the antenna is in use.

When it is desired to store the antenna or stow it alongside the elongated telescoping means, the cap plate is removed against the spring tension and the upper end of the spring means is provided with a hook for engaging the telescoping means and keeping the spring in a tension mode while allowing the cap plate along with the antenna to be folded alongside the antenna mount without the use of any tools or the loosening of any screws or the like.

DESCRIPTION OF THE DRAWINGS

Other and further advantageous features for the present invention will hereinafter more fully appear in connection with a detailed description of the drawings in which.

DETAILED DESCRIPTION OF THE PREFERRED EMBODIMENT

Figure 1:
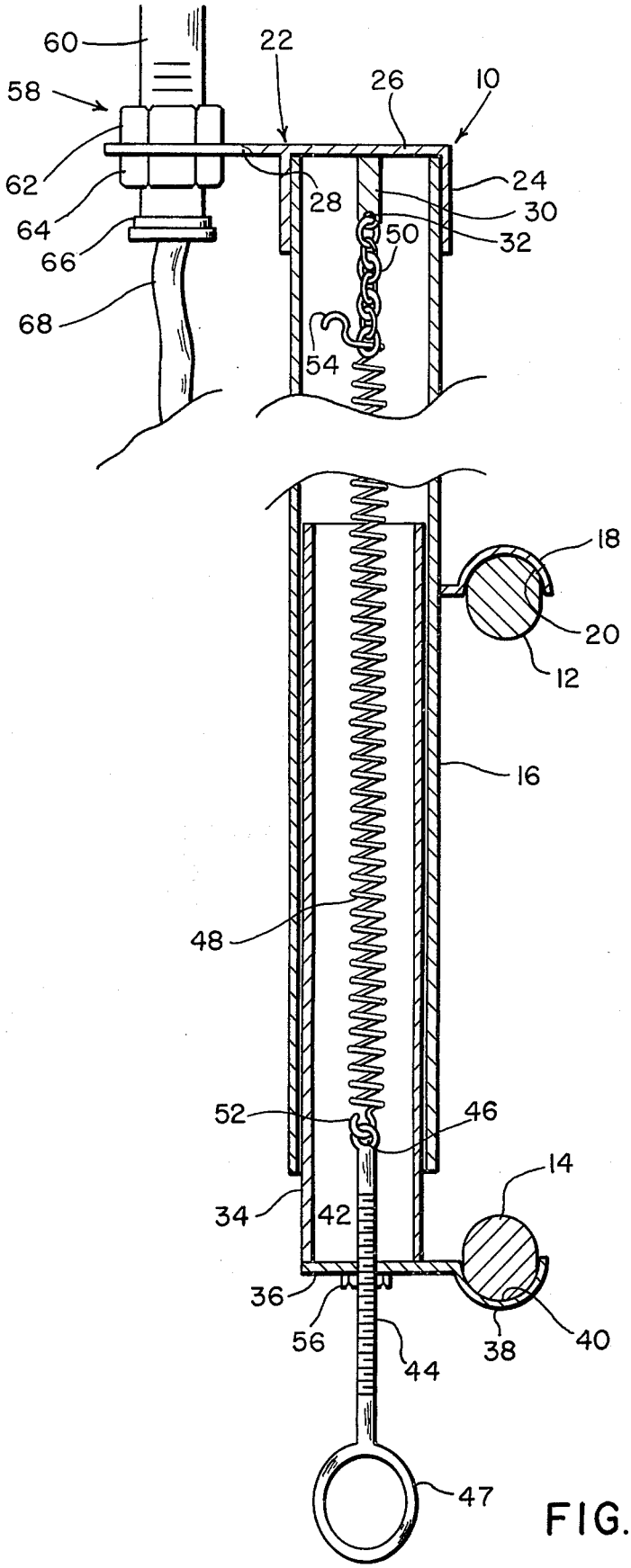
FIG. 1 is an elevational sectional view of antenna attachment means embodying the present invention and mounted on a rearview mirror frame means.

Referring to the drawings in detail reference character 10 generally indicates an antenna attachment means which is mounted to a pair of spaced rearview mirror frame mirrors 12 and 14 which normally extend horizontally outwardly from a truck-tractor or other similar vehicle (not shown).

The attachment means 10 comprises an outer elongated sleeve member 16 which is open at both ends and is provided with an outwardly extending hook member 18 which is secured to the outer wall of the sleeve 16 in any well known manner such as by welding as shown in the drawings. The hook member 18 has an inner face 20 which is shaped to receive the rearview mirror mounting frame 12 therein.

An end cap plate 22 is provided and comprises a tubular portion 24 having an inside diameter substantially equal to the outside diameter of the sleeve 16 for slidably receiving one end of the said sleeve 16 therein. The end plate 22 is provided with an elongated plate member 26 which covers the end of the tube 24 and also extends outwardly to form an antenna mounting plate 28. An attachment stud 30 is secured to the end plate 26 interior in the end thereof for a purpose that will be hereinafter set forth. The stud 30 has an eyelet 32 in the end thereof.

The attachment means 10 also comprises an inner elongated sleeve member 34 which has an outside diameter substantially equal to or smaller than the inside diameter of the sleeve member 16 so that the sleeve member 34 may be slidably received within the sleeve member 16 to form a telescoping sleeve arrangement. One end of the sleeve 34 is open and the other end is closed by means of an end plate 36 which is attached thereto by any well known manner such as by welding. The end plate 36 also has an outwardly extending hook member 38 which is made a part thereof and is oppositely disposed and similar in shape to the hook member 18 of the outer sleeve 16. The hook member 38 is provided with the interior surface 40 which is shaped to receive the second rearview mirror mounting frame member 14 therein.

The end plate 36 is provided with a centrally disposed bore 42 therein for slidably receiving an elongated threaded rod therethrough. One end of the rod 44 extends longitudinally into the sleeve member 34 and is provided with an eyelet 46 therein. The opposite end of the rod 44 extends outwardly from the plate 36 and is provided with an enlarged eyelet 47 threadably attached thereto.

When the antenna attachment means is assembled the sleeve 34 is slidably disposed within the outer sleeve 16 and the eyelet 46 of the threaded rod 44 is attached to the eyelet 32 of the stud member 30 by a suitable yieldable means such as the elongated tension spring 48 and combination chain member 50. The spring member 48 is provided with a hook 52 at one end thereof for attaching to the rod 44 through the eyelet 46. The opposite end of the spring is provided with a similar outwardly extending hook 54 for a purpose that will be hereinafter set forth. The chain member 50 has one end thereof attached to the end of the spring 48 adjacent the hook 54 and the opposite end attached through the eyelet 32 to the stud 30.

Tension in the yieldable means 48 may be adjusted by means of the threaded rod 44 and a suitable adjustment nut 56 which is threaded on the rod 44 and is engageable with the outer surface of the end plate 36.

Reference character 58 generally depicts a typical C-B antenna 60 which is mounted to the plate 28 by oppositely disposed nuts 62 and 64, the nut 64 being provided with a suitable cable attachment means 66 for receiving and securing a coaxial type antenna cable 68 therein. The opposite end of the coaxial cable 68 is attached to the transmitting and receiving equipment (not shown).

In operation when a driver desires to connect his C-B antenna to a rearview mirror mount of a tractor, he simply places the hook 18 over the upper rearview mirror mount 12 and by grasping the opposite sleeve member 38 pulls the inner sleeve downwardly against the force of the spring 48 and attaches the hook 38 to the lower rearview mirror mount 14. The adjustment of the spring 48 may then be accomplished by grasping the eyelet 47 and pulling rod 44 downwardly against the tension in the spring. While the eyelet is pulled downwardly the adjustment nut 56 may be then either lowered to reduce spring tension or raised to increase the spring tension.

The coaxial cable 68, if it is unattached, may then be attached to the base of the antenna 60 for operation of the equipment.

Since the cap plate 22 is secured to the upper end of the outer sleeve 16 by means of the tube portion 24, the antenna mount is free to pivot to a certain extent. However, when the antenna mount is pulled into tension and attached to the rearview mirror mount, the extra tension in the spring substantially prevents the antennas from rotating about its vertical axis mount.

Figure 2:
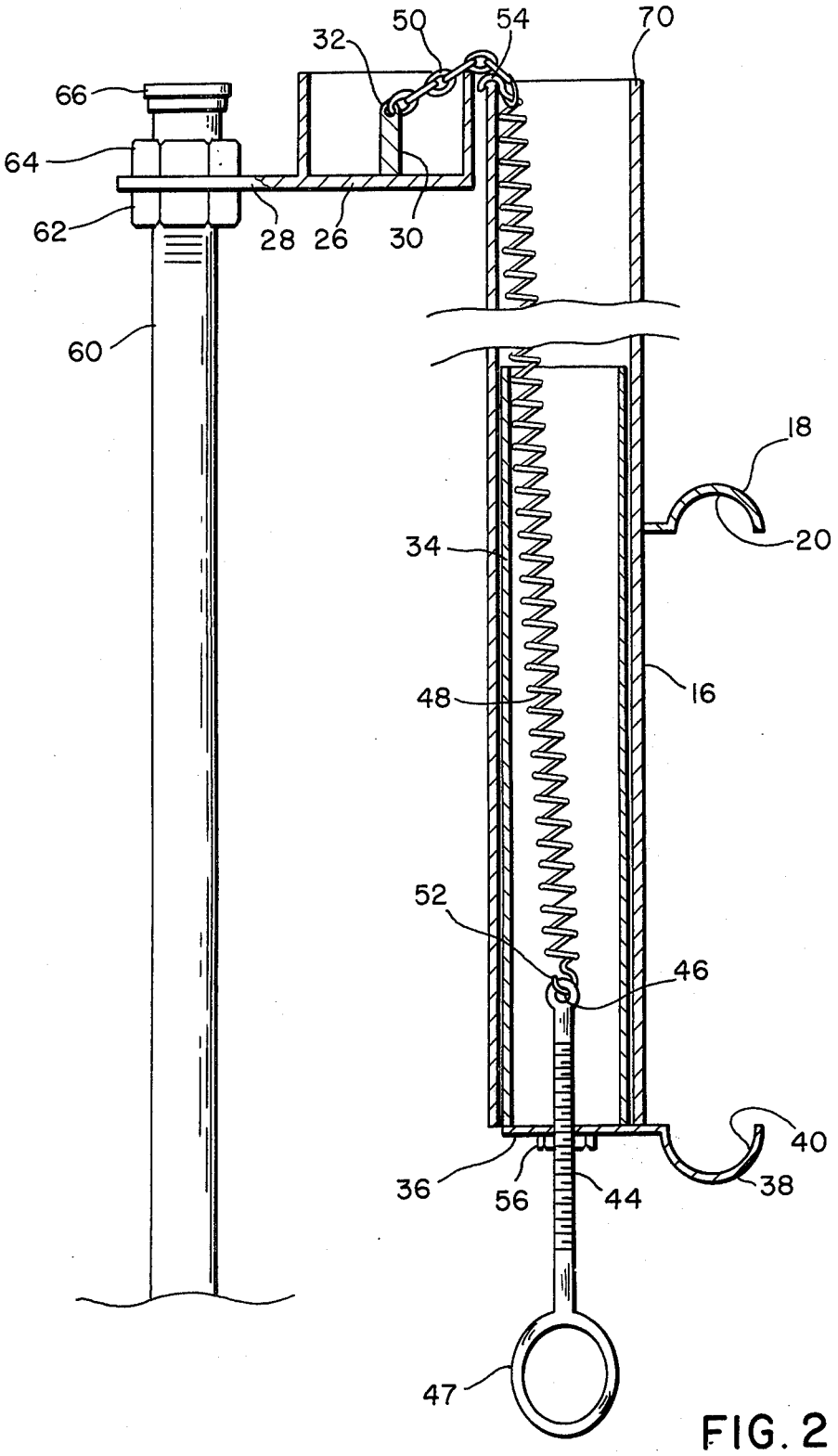
FIG. 2 is an elevational sectional view of the antenna attachment means shown in FIG. 1 in a collapsed or folded position.

When it is necessary for the driver to change vehicles or to remove the equipment for stowage, he may simply execute the following steps. He may or may not according to his desire remove the coaxial cable 68 from the base of the antenna 60. He then grasps the lower hook 38 and pulls the inner sleeve 34 downwardly to disengage the hooks 38 and 18 from their respective rearview mirror mounts 14 and 12. He then allows the spring tension 48 to pull the inner sleeve 34 within the outer sleeve 16 as shown in FIG. 2.

Since the combined length of the antenna 60 in the attachment means 10 is normally too great for easy storage, the driver may then lift the cap plate 22 off of the outer sleeve 16 against the tension of the spring 48. He then raises the cap plate 22 to a height necessary to secure the hook member 54 to the outer end 70 of the outer sleeve 16, thereby allowing the antenna direction to be reversed and lay alongside the attachment mount 10 for compact storage purposes. The steps may be then reversed in order to reconnect the antenna to the rearview mirror mounts of another truck or vehicle.

From the foregoing, it is apparent that the present invention provides an adjustable attachment means for quickly and easily securing a radio antenna to rearview mirror mounts of a truck of similar vehicle without the use of any auxiliary tools or equipment.

Whereas the present invention has been described in particular relation to the drawings attached hereto, other and further modifications apart from those shown or suggested herein may be made within the spirit of scope of the invention.

What is claimed:

1. Antenna attachment means for removable attachment of a radio antenna to a vehicle rearview mirror mount and comprising:
   a. an elongated outer sleeve member having a first mounting hook secured thereto.
   b. an elongated inner sleeve member having one end thereof slidably disposed within the outer sleeve member, the opposite end having an end plate secured thereto and a second mounting hook secured thereto and disposed oppositely from the first mounting hook.
   c. a cap plate removably secured to one end of the outer sleeve opposite the inner sleeve end plate and having means for attaching the radio antenna thereto.
   d. yieldable means disposed within the sleeve member one end thereof being attached to the inner sleeve end plate and the opposite end being attached to the cap plate, the yieldable means having a hook secured thereto and spaced from the cap plate, said hook being engageable with the end of the outer sleeve when the cap plate is removed from the outer sleeve against the force of the yieldable means.

2. Antenna attachment means as set forth in claim 1 wherein the second mounting hook is made as an integral part of the end plate and serves as a stop to prevent the inner sleeve from being pulled completely into the outer sleeve by the yieldable means.

3. Antenna attachment means as set forth in claim 1 wherein the cap plate comprises a sleeve section for receiving the end of the outer sleeve member therein and an elongated plate having one end connected to one end of the sleeve section and the opposite end comprising the means for attaching the radio antenna thereto.

4. Antenna attachment means as set forth in claim 1 wherein the yieldable means comprises an elongated tension spring having one end attached to the inner sleeve end plate and the hook being disposed at the opposite end thereof, a flexible line being secured between the cap plate and the end of the yieldable means adjacent to the hook.

5. Antenna attachment means as set forth in claim 4 wherein the flexible line is a chain.

6. Antenna attachment means as set forth in claim 1 wherein the end plate is provided with a centrally disposed hole, and elongated threaded rod slidably disposed through the hole and has one end attached to one end of the yieldable means, and an adjustment nut threadably secured to the rod for engaging the outer surface of the end plate whereby the yieldable means tension can be adjusted by moving the nut along the rod.

* * * * *